US007758089B2

(12) United States Patent
Lee et al.

(10) Patent No.: US 7,758,089 B2
(45) Date of Patent: Jul. 20, 2010

(54) ROLL FORMING APPARATUS, METHOD THEREOF, AND BUMPER BEAM MANUFACTURED BY THE METHOD

(75) Inventors: Mun Yong Lee, Busan (KR); Jung Su Yoo, Busan (KR)

(73) Assignee: Sungwoo Hitech Co., Ltd., Jeongkwan-myeon, Kijang-kun, Busan (KR)

( * ) Notice: Subject to any disclaimer, the term of this patent is extended or adjusted under 35 U.S.C. 154(b) by 329 days.

(21) Appl. No.: 11/954,115

(22) Filed: Dec. 11, 2007

(65) Prior Publication Data

US 2008/0155804 A1 Jul. 3, 2008

(30) Foreign Application Priority Data

Dec. 27, 2006 (KR) ..... 10-2006-0134444
Dec. 27, 2006 (KR) ..... 10-2006-0134445

(51) Int. Cl.
*B60R 19/18* (2006.01)
*B21D 53/88* (2006.01)

(52) U.S. Cl. ..... 293/102; 293/120; 29/897.2; 29/279; 72/370.19

(58) Field of Classification Search ..... 293/102, 293/120, 122, 133; 29/897.2, 779, 34 R, 29/428, 455.1; 228/17.5, 146, 150; 72/369, 72/368, 370.19
See application file for complete search history.

(56) References Cited

U.S. PATENT DOCUMENTS 2,406,051 A * 8/1946 Weiss ..... 156/462
3,033,734 A * 5/1962 Price ..... 156/305
4,221,413 A * 9/1980 Bonnetain ..... 293/122
5,104,026 A * 4/1992 Sturrus et al. ..... 228/17.5
5,395,036 A * 3/1995 Sturrus ..... 228/146
5,934,544 A * 8/1999 Lee et al. ..... 228/146
6,179,204 B1 * 1/2001 Blower et al. ..... 229/178
6,644,535 B2 * 11/2003 Wallach et al. ..... 228/173.5
6,813,920 B2 * 11/2004 Yoshida et al. ..... 72/166
7,007,989 B2 * 3/2006 Yoon ..... 293/120
7,073,259 B2 * 7/2006 Sundgren et al. ..... 29/897.35
7,197,822 B2 * 4/2007 Voit et al. ..... 29/890
2002/0062546 A1 * 5/2002 Obeshaw ..... 29/423
2004/0197519 A1 * 10/2004 Elzey et al. ..... 428/68
2005/0089707 A1 * 4/2005 Obeshaw ..... 428/593
2008/0012364 A1 * 1/2008 Boggess ..... 293/120
2008/0111385 A1 * 5/2008 Haneda et al. ..... 293/102
2008/0284183 A1 * 11/2008 Johnson ..... 293/102
2009/0165520 A1 * 7/2009 Koo et al. ..... 72/168

FOREIGN PATENT DOCUMENTS

DE 1 452 956 A 6/1969
DE 30 32 238 C2 3/1981
DE 103 29 002 A1 1/2005
DE 601 08 239 T2 2/2006
KR 10-2004-0105142 12/2004
KR 10-2005-0117296 12/2005

* cited by examiner

*Primary Examiner*—Jason S Morrow

(57) ABSTRACT

A roll forming apparatus and a method thereof form a composite panel by simultaneously roll forming upper and lower plates with different thicknesses and a zigzag-shaped core panel, and welding them together. A bumper beam is manufactured by using the composite panel.

5 Claims, 6 Drawing Sheets

ROLL FORMING APPARATUS, METHOD THEREOF, AND BUMPER BEAM MANUFACTURED BY THE METHOD

CROSS-REFERENCE TO RELATED APPLICATION

This application claims priority to and the benefit of Korean Patent Applications No. 10-2006-0134444 and No. 10-2006-0134445 filed in the Korean Intellectual Property Office on Dec. 27, 2006, the entire contents of which are incorporated herein by reference.

BACKGROUND OF THE INVENTION (a) Field of the Invention

The present invention relates to a roll forming apparatus, a method thereof, and a bumper beam manufactured by the method. More particularly, the present invention relates to a roll forming apparatus and a method thereof that make a composite panel by simultaneously roll forming upper and lower plates with thicknesses that are different from each other and a zigzag-shaped core panel, and welding them together, and to a bumper beam manufactured by using the composite panel.

(b) Description of the Related Art

Generally, a bumper unit of a vehicle minimizes physical damage of a vehicle body by being deformed elastically, and enhances safety of a driver or occupants by absorbing collision energy when an accident occurs. The bumper units are mounted at front and rear portions of the vehicle.

As shown in FIG. 1, such a bumper unit of a vehicle includes a bumper beam 201 mounted at front and rear portions of the vehicle and disposed along a width direction of the vehicle, an energy absorber 203 disposed in front of the bumper beam 201 and absorbing collision energy, a bumper cover 205 covering the bumper beam 201 and the energy absorber 203, and a stay 209 connecting the bumper beam 201 with a front side member 207.

Therefore, the energy absorber 203 is compressed and a part of the collision energy is absorbed by the energy absorber 203 when collision occurs. In addition, the other part of the collision energy that is not absorbed by the energy absorber 203 is absorbed by a vehicle body through the bumper beam 201 and the stay 209.

A straight-type beam, such as the bumper beam, is manufactured by a roll forming apparatus including more than 10 roll formers that consist of an upper roller and a lower roller and are disposed in series. The roll formers bend a panel into various shapes.

As shown in FIG. 2, such a roll forming apparatus includes an uncoiler 101 provided at a front portion in a process line and performing an uncoiling step S110 where a coil 100 is uncoiled to be a plate 102, and a straightener 103 provided at the rear of the uncoiler 101 in the process line and performing a straightening step S120 where the plate 102 supplied from the uncoiler 101 is straightened to be a panel 200.

In addition, the roll forming apparatus further includes a brake press 105 provided at the rear of the straightener 103 and performing a piercing step S130 where a plurality of holes for assembling a bumper beam are bored in the panel 200 supplied from the straightener 103.

In addition, the roll forming apparatus further includes a plurality of roll formers R1, R2, R3, R4, R5, R6, and R7 provided at the rear of the brake press 105 and performing a roll forming step S140 where the panel 200 supplied through the uncoiler 101, the straightener 103, and the brake press 105 is bent to form a bumper beam 300 shown in FIG. 3.

However, only one panel 200 can be manufactured by the conventional roll forming apparatus. Thus, two conventional roll forming apparatuses may be needed for manufacturing a bumper beam consisting of two panels. That is, two panels are separately manufactured by the two conventional roll forming apparatuses and are welded together. Therefore, productivity may deteriorate and product cost may rise.

Further, a new roll forming apparatus is needed in order to manufacture a bumper beam made of a sandwich-type composite panel.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention has been made in an effort to provide a roll forming apparatus and a method thereof having advantages of manufacturing a sandwich-type composite panel by simultaneously roll forming upper and lower plates with thicknesses that are different from each other and a zigzag-shaped core panel, and welding them together.

In addition, the present invention has been made in an effort to provide a roll forming apparatus and a method thereof having further advantages of reducing product cost of a bumper beam as a consequence of the sandwich-type composite panel being bent to have a specific shape after being formed by simultaneously welding together upper and lower plates and a core panel disposed therebetween.

A roll forming apparatus according to an exemplary embodiment of the present invention may include: a first uncoiler provided at a front portion of a process line, the first uncoiler uncoiling a first coil to form a middle plate and supplying the middle plate; a roll core former provided at the rear of the first uncoiler in the process line, the roll core former bending the middle plate supplied from the first uncoiler to be a zigzag shape so as to form a core panel; a second uncoiler provided at the rear of the roll core former in the process line, the second uncoiler uncoiling upper and lower coils to respectively form upper and lower plates and supplying the upper and lower plates to respective upper and lower surfaces of the core panel; a guide roller provided at the rear of the second uncoiler in the process line, the guide roller guiding and aligning both sides of the core panel and the upper and lower plates supplied from the second uncoiler; a roller welder provided at the rear of the guide roller in the process line, the roller welder welding the core panel and the upper and lower plates by using upper and lower roller electrodes so as to make a sandwich-type composite panel; a brake press provided at the rear of the roller welder in the process line, the brake press boring a plurality of holes for assembling a bumper beam in the composite panel supplied from the roller welder; and a roll former unit provided at the rear of the brake press in the process line and including a plurality of roll formers disposed in series, the roll former unit bending the composite panel supplied from the brake press to form the bumper beam.

The upper coil for the upper plate may be mounted at an upper portion of the second uncoiler, and the lower coil for the lower plate may be mounted at a lower portion of the second uncoiler and be disposed apart from the upper coil such that the core panel passes therebetween.

A roll forming method using the roll forming apparatus may include: uncoiling a first coil to form a middle plate; forming a core panel by bending the middle plate to be a zigzag shape; uncoiling upper and lower coils to respectively form upper and lower plates; supplying the upper and lower plates to respective upper and lower surfaces of the core panel; aligning both sides of the core panel and the upper and lower plates; welding the core panel and the upper and lower plates to make a sandwich-type composite panel; boring a plurality of holes for assembling a bumper beam in the composite panel; and bending the composite panel to form the bumper beam.

The upper coil may be uncoiled to be the upper plate and be supplied to the upper surface of the core panel, and the lower coil may be uncoiled to be the lower plate and be supplied to the lower surface of the core panel.

A bumper beam may be manufactured to have a specific shape by the roll forming method of the present invention, wherein a front surface of the bumper beam is a curved surface.

The specific shape may include: a front round wall having upper and lower ends and a middle portion, the middle portion of the front round wall protruding from the upper and lower ends thereof; a top wall having two ends, one end thereof being connected with the upper end of the front round wall at a first bent portion; a bottom wall having two ends, one end thereof being connected with the lower end of the front round wall at a second bent portion; an upper rear wall having upper and lower ends, the upper end thereof being connected with the other end of the top wall at a third bent portion; a lower rear wall having upper and lower ends, the lower end thereof being connected with the other end of the bottom wall at a fourth bent portion; an upper inner wall having two ends, one end thereof being connected with the lower end of the upper rear wall at a fifth bent portion; a lower inner wall having two ends, one end thereof being connected with the upper end of the lower rear wall at a sixth bent portion; and a welding portion connected with the other ends of the upper inner wall and the lower inner wall and bent toward the middle portion of the front round wall.

The welding portion may include an upper welding portion having two ends, one end thereof being connected with the other end of the upper inner wall at a seventh bent portion and the other end thereof being bent toward the middle portion of the front round wall; and a lower welding portion having two ends, one end thereof being connected with the other end of the lower inner wall at an eighth bent portion and the other end thereof being bent toward the middle portion of the front round wall and being welded with the other end of the upper welding portion.

DETAILED DESCRIPTION OF THE EMBODIMENTS

Hereinafter, exemplary embodiments of the present invention will be described in detail with reference to the accompanying drawings.

Figure 1:
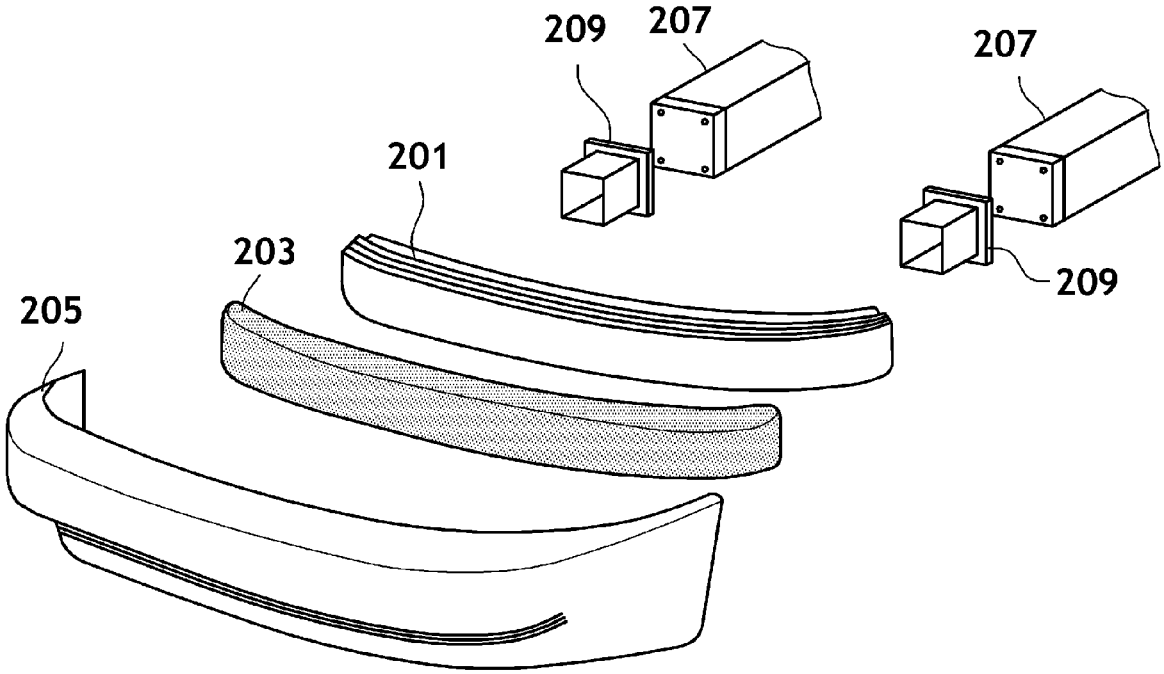
FIG. 1 is an exploded perspective view of a bumper unit of a vehicle.
Figure 2:
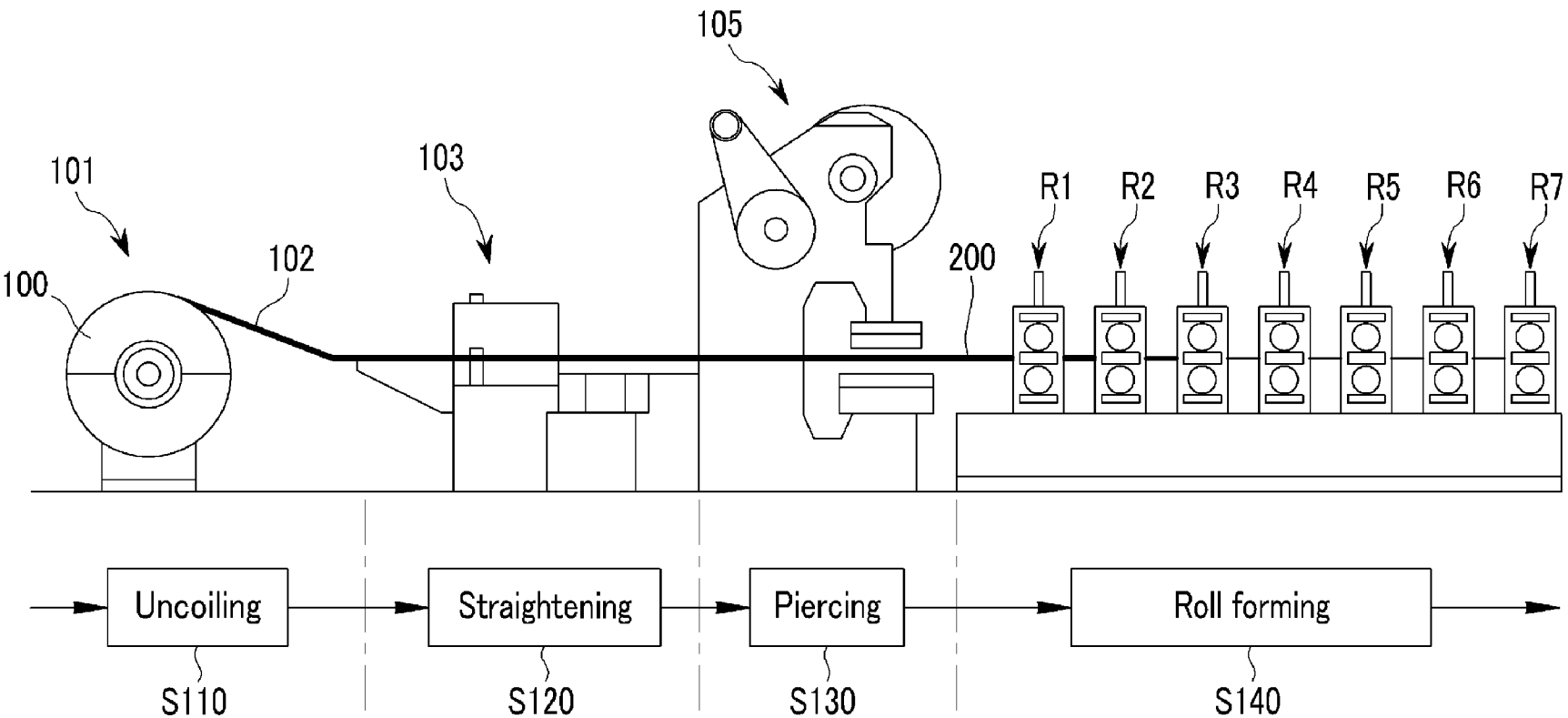
FIG. 2 is a schematic diagram of a conventional roll forming apparatus.
Figure 3:
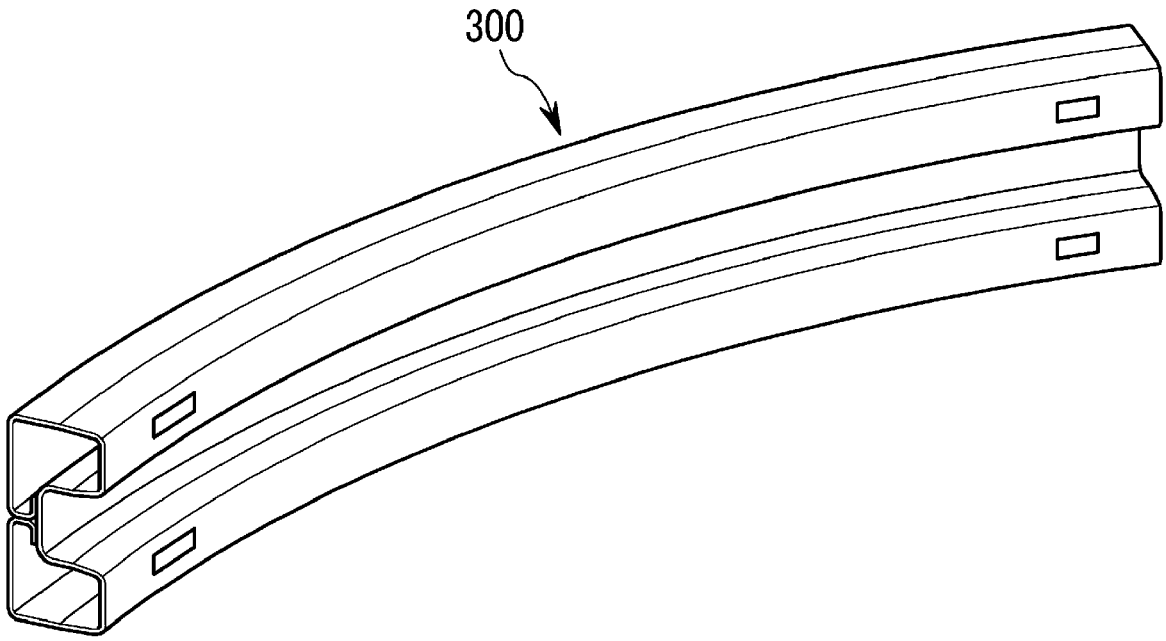
FIG. 3 is a perspective view of a bumper beam manufactured by a conventional roll forming apparatus and a method thereof.
Figure 4:
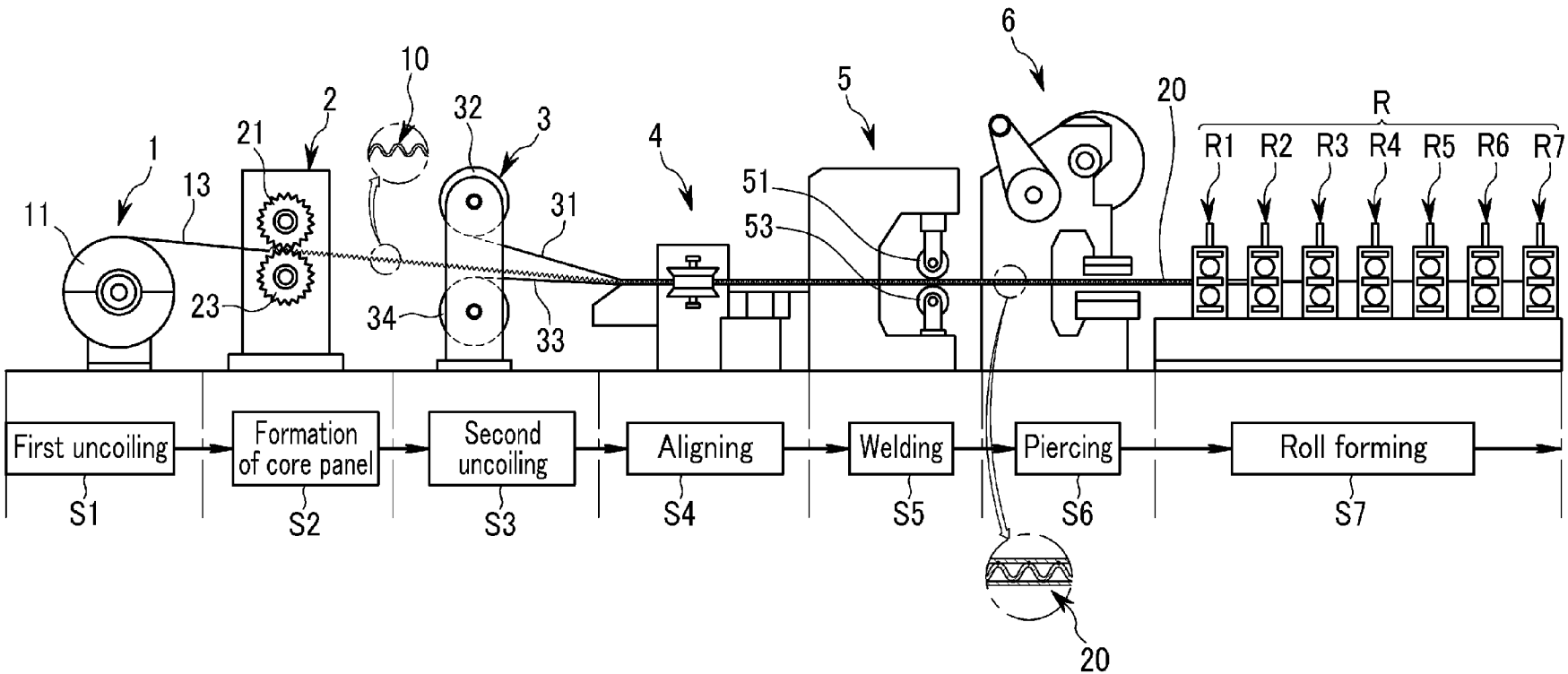
FIG. 4 is a schematic diagram of a roll forming apparatus according to an exemplary embodiment of the present invention.
Figure 5:
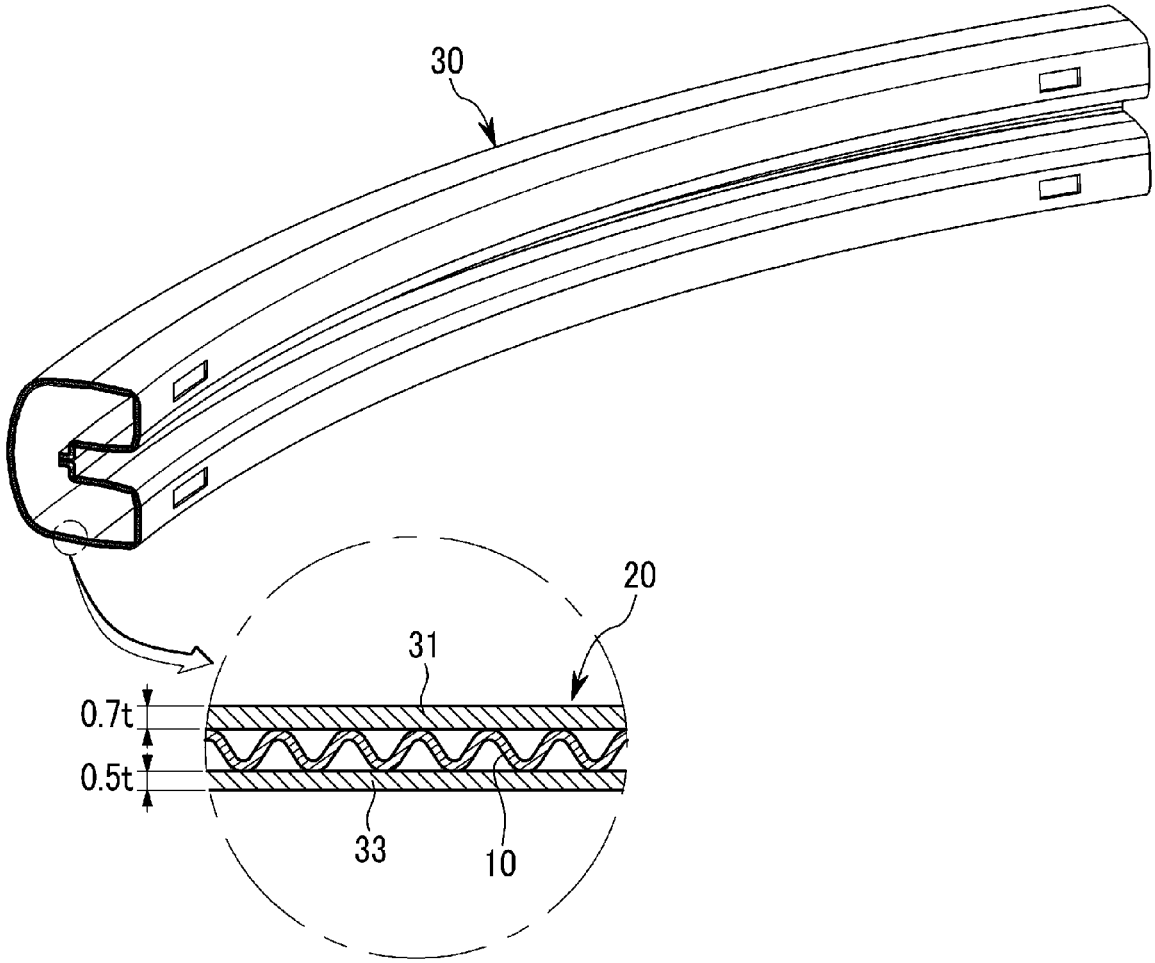
FIG. 5 is a perspective view of a bumper beam manufactured by a roll forming apparatus and a method thereof according to an exemplary embodiment of the present invention.
Figure 6:
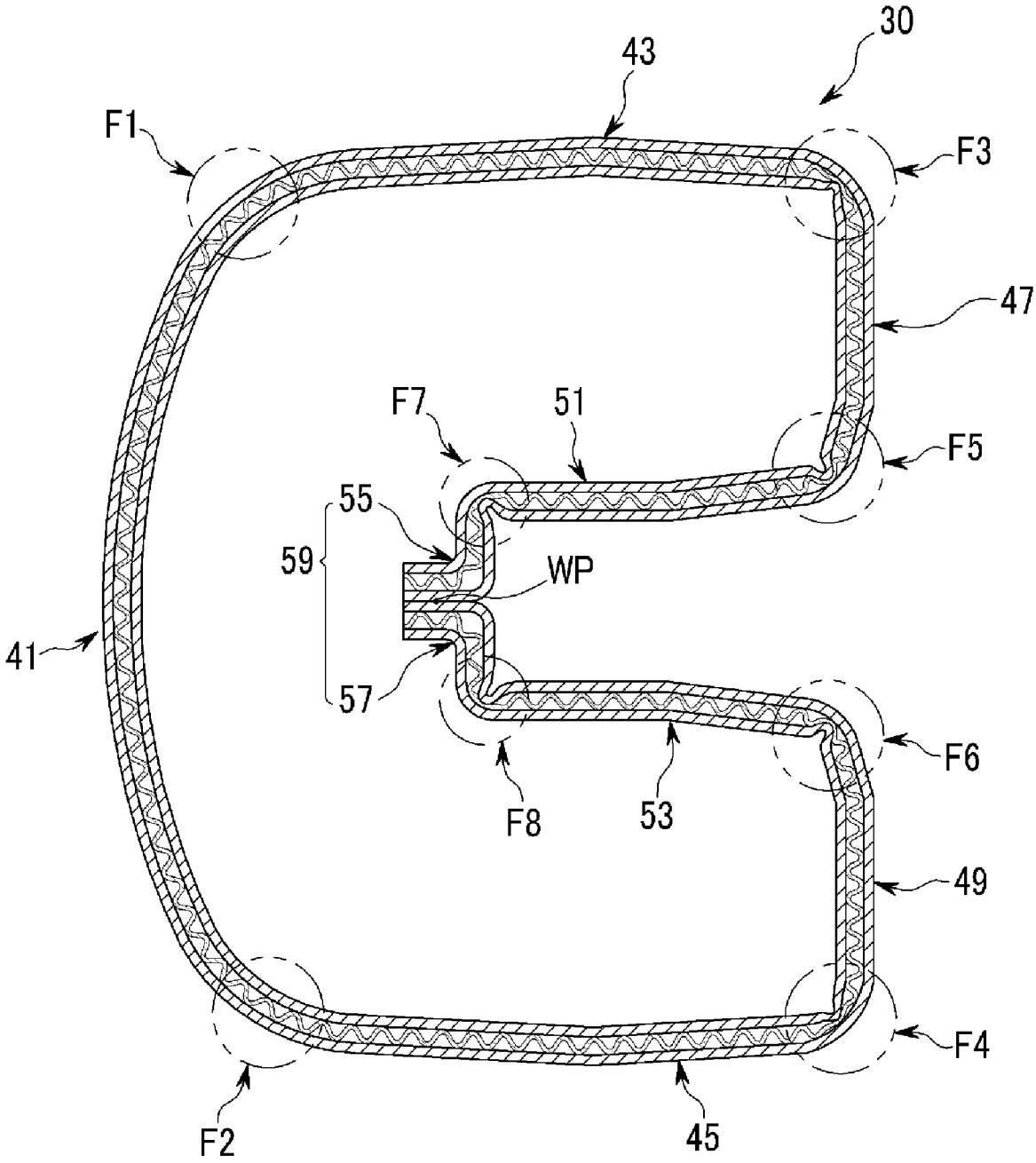
FIG. 6 is a cross-sectional view of a bumper beam manufactured by a roll forming apparatus and a method thereof according to an exemplary embodiment of the present invention.

FIG. 4 is a schematic diagram of a roll forming apparatus, FIG. 5 is a perspective view of a bumper beam manufactured by a roll forming apparatus and a method thereof, and FIG. 6 is a cross-sectional view of a bumper beam manufactured by a roll forming apparatus and a method thereof according to an exemplary embodiment of the present invention.

A roll forming apparatus according to an exemplary embodiment of the present invention includes a first uncoiler 1, a roll core former 2, a second uncoiler 3, a guide roller 4, a roller welder 5, a brake press 6, and a roll former unit R, as shown in FIG. 4. The first uncoiler 1 is provided at a front portion of a process line and uncoils a first coil 11 to form a middle plate 13.

The roll core former 2 is provided at the rear of the first uncoiler 1 in the process line and includes saw-toothed upper and lower rollers 21 and 23. The upper and lower rollers 21 and 21 bend the middle plate 13 supplied from the first uncoiler 1 to be a zigzag shape so as to form a core panel 10.

The second uncoiler 3 is provided at the rear of the roll core former 2 in the process line and uncoils upper and lower coils 32 and 34 to form upper and lower plates 31 and 33, respectively. The upper and lower plates 31 and 33 are supplied to upper and lower surfaces of the core panel 10 supplied from the roll core former 2, respectively.

The upper coil 32 is mounted at an upper portion of the second uncoiler 3 and the lower coil 34 is mounted at a lower portion of the second uncoiler 3. The lower coil 34 is disposed apart from the upper coil 32 by a predetermined distance such that the core panel 10 passes between the upper and lower coils 32 and 34.

The guide roller 4 is provided at the rear of the second uncoiler 3 in the process line and aligns both sides of the core panel 10 and the upper and lower plates 31 and 33.

The roller welder 5 is provided at the rear of the guide roller 4 in the process line and includes upper and lower roller electrodes 52 and 54. The upper and lower roller electrodes 52 and 54 apply an electric current to the core panel 10 and upper and lower plates 31 and 33 overlapped with each other such that the core panel 10 and upper and lower plates 31 and 33 are welded to be a sandwich-type composite panel 20.

The brake press 6 is provided at the rear of the roller welder 5 in the process line and bores a plurality of holes for assembling a bumper beam 30 in the composite panel 20 supplied from the roller welder 5.

The roll former unit R is provided at the rear of the brake press 6 in the process line and includes a plurality of roll formers R1, R2, R3, R4, R5, R6, and R7 disposed in series. The roll former unit R bends the sandwich-type composite panel 20 supplied through the first uncoiler 1, the roll core former 2, the second uncoiler 3, the guide roller 4, the roller welder 5, and the brake press 6 to form the bumper beam 30 shown in FIG. 5.

Hereinafter, a roll forming method for manufacturing the bumper beam 30 by using the sandwich-type composite panel 20 that is performed by the roll forming apparatus according to an exemplary embodiment of the present invention will be explained. The first uncoiler 1 disposed at the front portion of the process line uncoils a first coil 11 to form the middle plate 13 at step S1, and supplies the middle plate 13 to the roll core former 2.

The roll core former 2 forms the core panel 10 by bending the middle plate 13 supplied from the first uncoiler 1 to be a zigzag shape at step S2.

The second uncoiler 3 uncoils the upper and lower coils 32 and 34 to form the upper and lower plates 31 and 33 at step S3, and supplies the upper and lower plates to the upper and lower surfaces of the core panel 10 supplied from the roll core former, respectively.

In this case, the upper coil 32 is uncoiled to be the upper plate 31 and is supplied to the upper surface of the core panel 10, and the lower coil 34 is uncoiled to be the lower plate 33 and is supplied to the lower surface of the core panel 10 at the step S3.

The guide roller 4 provided at the rear of the second uncoiler 3 in the process line aligns both sides of the core panel 10 and the upper and lower plates 31 and 33 supplied from the second uncoiler 3 at step S4.

The roller welder 5 provided at the rear of the guide roller 4 in the process line welds the core panel 10 and the upper and lower plates 31 and 33 overlapped with each other to be the sandwich-type composite panel 20 by using the upper and lower roller electrodes 52 and 54 at step S5.

The brake press 6 provided at the rear of the roller welder 5 bores the plurality of holes in the composite panel 20 at step S6. The plurality of holes are used for assembling the bumper beam 30.

The sandwich-type composite panel 20 is supplied to the roll former unit R and is bent to be the bumper beam 30 of a specific shape by the roll formers R1, R2, R3, R4, R5, R6, and R7 at step S7.

Hereinafter, the bumper beam 30 according to an exemplary embodiment of the present invention will be described in detail.

As shown in FIG. 6, the bumper beam 30 includes a front round wall 41, a top wall 43, a bottom wall 45, an upper rear wall 47, a lower rear wall 49, an upper inner wall 51, a lower inner wall 53, and a welding portion 59.

The front round wall 41 includes upper and lower ends and a middle portion. The middle portion protrudes from the upper and lower ends such that the front wall has an arc-shape. The upper end of the front round wall 41 is connected with one end of the top wall 43 at a first bent portion F1, and the lower end of the front round wall 41 is connected with one end of the bottom wall 45 at a second bent portion F2. The top wall 43 and the bottom wall 45 are disposed substantially perpendicular to the front round wall 41 and are disposed in parallel with each other.

The other end of the top wall 43 is connected with an upper end of the upper rear wall 47 at a third bent portion F3, and the other end of the bottom wall 45 is connected with a lower end of the lower rear wall 49 at a fourth bent portion F4. The upper rear wall 47 is disposed substantially perpendicular to the top wall 43, and the lower rear wall 49 is disposed substantially perpendicular to the bottom wall 45.

A lower end of the upper rear wall 47 is connected with one end of the upper inner wall 51 at a fifth bent portion F5. The upper inner wall is disposed in parallel with the top wall 43.

In addition, an upper end of the lower rear wall 49 is connected with one end of the lower inner wall 53 at a sixth bent portion F6. The lower inner wall 53 is disposed in parallel with the bottom wall 45.

The third, fourth, fifth, and sixth bent portions F3, F4, F5, and F6 are pressed along a bending direction according to edge forming. Thus, the bent portions are formed precisely.

The other end of the upper inner wall 51 and the other end of the lower inner wall 53 are connected with the welding portion 59. The welding portion 59 is bent toward the middle portion of the front round wall 41 and includes upper and lower welding portions 55 and 57. One end of the upper welding portion 55 is connected with the other end of the upper inner wall 51 at a seventh bent portion F7 and the other end of the upper welding portion 55 is bent toward the middle portion of the front round wall 41. One end of the lower welding portion 57 is connected with the other end of the lower inner wall 53 at an eighth bent portion F8 and the other end of the lower welding portion 57 is bent toward the middle portion of the front round wall 41. The other end of the lower welding portion 57 is contacted with and is welded together with the other end of the upper welding portion 55.

The seventh and eighth bent portions F7 and F8 are pressed along a bending direction according to edge forming. Thus, the bent portions are formed precisely.

According to the bumper beam 30 of this invention, the welding point WP may be minimized and impact-absorbing performance may be enhanced as a consequence of the bumper beam 30 being made of the composite panel 20 having high energy-absorbing performance and the front round wall 41 receiving impact energy having the arc-shape.

That is, the conventional bumper beam 300 absorbs impact energy by being deformed elastically. However, according to the bumper beam 30 of this invention, impact energy is transmitted sequentially through the upper plate 31, the core panel 10, and the lower plate 33, and the core panel 10 of the zigzag shape slightly absorbs the impact energy.

In addition, according to the bumper beam 30 of this invention, the zigzag-shaped core panel 10 disperses and transmits the impact energy in various directions.

As described above, according to the present invention, a sandwich-type composite panel is manufactured by simultaneously roll forming upper and lower plates with different thicknesses and a zigzag-shaped core panel, and welding them together. Therefore, product cost of a bumper beam may be reduced.

In addition, a sandwich-type composite panel is disposed between upper and lower plates and is roll formed together with the upper and lower plates according to the present invention, and since the composite panel absorbs impact energy, energy-absorbing performance may be enhanced.

Further, since a front round wall that receives impact energy has the arc-shape, the impact energy may be dispersed and transmitted in various directions according to the present invention.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A roll forming method, comprising:

uncoiling a first coil to form a middle plate;

forming a core panel by bending the middle plate to be a zigzag shape;

uncoiling upper and lower coils to form upper and lower plates, respectively;

supplying the upper and lower plates to upper and lower surfaces of the core panel, respectively;

aligning both sides of the core panel and the upper and lower plates;

welding the core panel and the upper and lower plates to make a sandwich-type composite panel;

boring a plurality of holes for assembling a bumper beam in the composite panel; and bending the composite panel to form the bumper beam.

2. The roll forming method of claim 1, wherein the upper coil is uncoiled to be the upper plate and is supplied to the upper surface of the core panel, and the lower coil is uncoiled to be the lower plate and is supplied to the lower surface of the core panel.

3. The bumper beam manufactured to have a specific shape by the roll forming method of claim 1, wherein a front surface of the bumper beam has an arc-shape.

4. The bumper beam of claim 3, wherein the specific shape comprises:

a front round wall having upper and lower ends and a middle portion, the middle portion of the front round wall being protruded from the upper and lower ends thereof;

a top wall having two ends, one end thereof being connected with the upper end of the front round wall at a first bent portion;

a bottom wall having two ends, one end thereof being connected with the lower end of the front round wall at a second bent portion;

an upper rear wall having upper and lower ends, the upper end thereof being connected with the other end of the top wall at a third bent portion;

a lower rear wall having upper and lower ends, the lower end thereof being connected with the other end of the bottom wall at a fourth bent portion;

an upper inner wall having two ends, one end thereof being connected with the lower end of the upper rear wall at a fifth bent portion;

a lower inner wall having two ends, one end thereof being connected with the upper end of the lower rear wall at a sixth bent portion; and a welding portion connected with the other ends of the upper inner wall and the lower inner wall and bent toward the middle portion of the front round wall.

5. The bumper beam of claim 4, wherein the welding portion comprises:

an upper welding portion having two ends, one end thereof being connected with the other end of the upper inner wall at a seventh bent portion and the other end thereof being bent toward the middle portion of the front round wall; and a lower welding portion having two ends, the one end thereof being connected with the other end of the lower inner wall at an eighth bent portion and the other end thereof being bent toward the middle portion of the front round wall and being welded with the other end of the upper welding portion.

* * * * *